US009146538B2

(12) United States Patent
Hembo et al.

(10) Patent No.: US 9,146,538 B2
(45) Date of Patent: Sep. 29, 2015

(54) WATCH WITH REMOVABLE COVER ELEMENT AND MOVABLE ELEMENTS

(76) Inventors: Claus Skødt Hembo, Herning (DK); Christina Hembo, Herning (DK)

( * ) Notice: Subject to any disclaimer, the term of this patent is extended or adjusted under 35 U.S.C. 154(b) by 113 days.

(21) Appl. No.: 13/700,204

(22) PCT Filed: May 27, 2011

(86) PCT No.: PCT/DK2011/050178

§ 371 (c)(1),
(2), (4) Date: Dec. 14, 2012

(87) PCT Pub. No.: WO2011/147424

PCT Pub. Date: Dec. 1, 2011

(65) Prior Publication Data

US 2013/0083634 A1 Apr. 4, 2013

(30) Foreign Application Priority Data

May 27, 2010 (DK) ..... 2010 00465

(51) Int. Cl.

| | |
|---|---|
| ***G04B 39/00*** | (2006.01) |
| ***G04B 45/00*** | (2006.01) |
| ***G04B 37/12*** | (2006.01) |
| ***G04B 37/00*** | (2006.01) |
| ***G04B 47/04*** | (2006.01) |

(52) U.S. Cl.

CPC ..... *G04B 39/002* (2013.01); *G04B 37/005* (2013.01); *G04B 37/12* (2013.01); *G04B 45/00* (2013.01); *G04B 45/0076* (2013.01); *G04B 47/046* (2013.01)

(58) Field of Classification Search

CPC ..... G04B 47/046; G04B 47/042; G04B 37/1486; G04B 19/283; G04B 37/0008; G04B 37/005; G04B 45/0076; G04B 37/12; G04B 45/00; G04B 39/002

USPC ..... 368/283, 285, 286, 294, 295, 314, 233

See application file for complete search history.

(56) References Cited

U.S. PATENT DOCUMENTS

| | | | | | |
|---|---|---|---|---|---|
| 2,679,785 | A | * | 6/1954 | Batt | 359/441 |
| 4,734,895 | A | * | 3/1988 | Grosskopf | 368/229 |
| 4,945,523 | A | * | 7/1990 | Lam | 368/285 |
| 5,018,118 | A | * | 5/1991 | Ross | 368/228 |
| 5,119,350 | A | * | 6/1992 | Delacretaz et al. | 368/223 |

(Continued)

FOREIGN PATENT DOCUMENTS

| | | |
|---|---|---|
| CH | 609517 | 3/1979 |
| CH | 678255 | 8/1991 |

(Continued)

*Primary Examiner* — Amy Cohen Johnson
*Assistant Examiner* — Matthew Powell
(74) *Attorney, Agent, or Firm* — James Creighton Wray

(57) ABSTRACT

This invention discloses a watch comprising a housing comprising a watch case and a fixed attached watch glass, a first annular flange and a second concentric annular flange arranged outside the first flange, thereby defining a groove containing at least one moveable element, wherein said watch glass is attached to one of said flanges and where said watch glass is attached to the first flange, that said watch further comprises a cover element having a top ring with first connection means enclosing a cover glass, that said second flange is provided with second connection means releaseably cooperating with said first connection means and that said cover glass covers said watch glass and said groove.

16 Claims, 4 Drawing Sheets

(56) References Cited

U.S. PATENT DOCUMENTS

| | | | | |
|---|---|---|---|---|
| 5,224,078 | A * | 6/1993 | Mallin | 368/223 |
| 5,319,615 | A | 6/1994 | Ng | |
| 5,652,736 | A * | 7/1997 | Lee | 368/278 |
| 5,751,667 | A * | 5/1998 | Nunes | 368/223 |
| 5,793,710 | A * | 8/1998 | Jacobi, Jr. | 368/223 |
| 5,923,623 | A * | 7/1999 | Lee | 368/278 |
| 6,053,631 | A | 4/2000 | Mock | |
| 6,079,872 | A * | 6/2000 | Besson | 368/281 |
| 6,226,232 | B1 * | 5/2001 | Ruchonnet | 368/223 |
| 6,388,953 | B1 * | 5/2002 | Wu | 368/76 |
| 6,416,217 | B1 * | 7/2002 | Von Braunhut | 368/278 |
| 6,819,632 | B1 * | 11/2004 | Paul | 368/88 |
| 6,826,120 | B1 * | 11/2004 | Decker et al. | 368/10 |
| 7,333,399 | B2 * | 2/2008 | Ellner et al. | 368/88 |
| 2006/0193210 | A1 * | 8/2006 | Damasko | 368/295 |
| 2007/0189127 | A1 * | 8/2007 | Pollak | 368/294 |
| 2009/0022014 | A1 * | 1/2009 | Gracia et al. | 368/311 |
| 2009/0303843 | A1 * | 12/2009 | Albano | 368/281 |
| 2010/0302915 | A1 * | 12/2010 | Grotell et al. | 368/285 |
| 2011/0044138 | A1 * | 2/2011 | Danthe et al. | 368/69 |
| 2012/0134244 | A1 * | 5/2012 | Margaritelli | 368/281 |

FOREIGN PATENT DOCUMENTS

| | | | |
|---|---|---|---|
| CN | 1101436 | A | 4/1995 |
| DE | 202005011789 | | 10/2005 |
| DE | 202009012008 | | 12/2009 |

* cited by examiner

WATCH WITH REMOVABLE COVER ELEMENT AND MOVABLE ELEMENTS

This application claims the benefit of Danish Application No. PA 2010 00465 filed May 27, 2010, and PCT/DK2011/050178 filed May 27, 2011, International Publication No. WO 2011/147424, which are hereby incorporated by reference in their entirety as if fully set forth herein.

FIELD OF THE INVENTION

The present invention relates to a watch comprising a housing comprising a watch case and a fixed attached watch glass, and a groove defined by two concentric annular flanges, where at least one moveable element is contained in the groove.

BACKGROUND OF THE INVENTION

Watches evolved in the $17^{th}$ century and have changed their appearance over time affected by the whims of fashion. For a multiplicity of years, the watches have been considered as not only a practical element for telling the time but also as a piece of jewelry. Therefore, watches do not only compete according to their function but also according to their appearance. Different types of decorations on watches were designed over the years and watches can be acquired for every occasion.

As an example of a decoration a watch can be provided with precious stones able to move inside the watch as described in CH 609517. CH 609517 discloses a watch with a housing delimited by a glass and a wall parallel to the glass where the watch contains moveable elements. The elements are able to slide parallel to one another in all directions depending on the movements of the wrist of the wearer of the watch. Each movable element consists of a precious stone arranged in a stone housing. When moving the wrist the user of the watch is able to change the appearance of the watch.

However in CH 609517, the user is bound by the number and colour of stones present in the watch since the user cannot remove or replace the stones by himself. The user is therefore not able to change the appearance of the watch by himself according to his mood or different occasions.

OBJECT OF THE INVENTION

It is the object of the invention to provide a watch being constructed in such way that the aesthetic appearance of a watch can be changed according to the wish of the user.

It is further the object of the invention to enable movable elements to be added, replaced or removed from the watch in a simple and easy manner by the user.

DESCRIPTION OF THE INVENTION

This object can be achieved by a watch comprising a housing comprising a watch case and a fixed attached watch glass, a first annular flange and a second concentric annular flange arranged outside the first flange, thereby defining a groove containing at least one moveable element, wherein said watch glass is attached to one of said flanges characterised in that said watch glass is attached to the first flange, that said watch further comprises a cover element having a top ring with first connection means enclosing a cover glass, that said second flange is provided with second connection means releaseably cooperating with said first connection means and that said cover glass covers said watch glass and said groove.

Hereby, a watch case and a fixed attached watch glass are provided in the watch where the fixed attached watch glass is fixed to a first annular flange comprised in the housing of the watch. Thus, an enclosure is formed protecting the mechanical and/or electrical parts of the watch along with possible hands of the watch and preventing the user from damaging the works of the watch, which could result in destroying the watch.

Throughout this document, user is to be understood as a person who is not skilled in the art of watches, but who has bought a watch and uses it.

A second annular flange is arranged outside and concentric to the first annular flange. Hereby, a groove is formed between the first and second annular flange. In this groove, one or more movable elements can be arranged either by the manufacturer or the user. The movable elements are able to move in the groove when the watch is moved.

The groove can take any form and shape suitable for at least one moveable element to be able to move in the groove. Thus, the shape of the groove could be adjusted to the shape of the at least one moveable element. If for example the at least one moveable element is a precious stone without a stone housing, the groove could be V-shaped for the stone to fit into the groove with a predetermined side to face against the glass without the risk of rotating (except from a rotation around a central axis) or being displaced.

On a non-limiting list the form of the groove can be U-shaped, V-shaped or shaped with substantially parallel sides and a bottom perpendicular to the sides. In one embodiment, the bottom of the groove is concave. A concave bottom prevents the at least one moveable element from rotating.

On top of the watch, a cover element is arranged. The cover element comprises a top ring, which encloses a cover glass. Thus, the cover glass covers both the watch glass and the groove. The cover glass prevents the at least one movable element from removal from the groove by accident.

In one embodiment, the cover glass is made from clear glass. Alternatively, the cover glass can be made from coloured glass. Alternatively, the cover glass can be made from different types of glass i.e. having a first type of glass in a first part of the cover glass, a second type of glass in a second part of the cover glass etc. However, at all times the material of the cover glass should not prevent the at least one moveable element or the time on the watch to be visible.

In one embodiment, the top ring comprises slanting edges, slanting from the cover glass towards the outer side of the cover element. This prevents forming of sharp edges, which could get caught in clothes etc.

The top ring can be made of materials such as plastic or metals, for example gold, silver, copper, white gold, titanium, tantalum or steel.

The top ring comprises first connection means which cooperate with second connection means provided on the second flange of the housing. Hereby, the top ring and, thus, the cover element are attached to the housing of the watch. The top ring cooperates with the second flange in a releasable manner. This means that the user is able to remove the cover element easily and optionally, without the use of any additional tools.

In one embodiment, the bottom of the top ring is arranged on the housing or in an annular recess formed along the upper side of the housing. Hereby, the outer side of the housing and the outer side of the top ring is substantially aligned. This prevents an edge to be formed by the bottom of the top ring. This edge could be inconvenient by getting caught by clothes etc.

When the user removes the cover element he is able to remove, replace and/or add movable elements to the groove of the housing. Thereafter, he connects the cover element on the watch. Hence, a new appearance of the watch is easily obtained. Since the sensitive mechanical and/or electric parts of the watch are protected by the watch glass, watch case and first annular flange, he need not worry about destroying the watch, even though he may wish to change the appearance of the watch often.

In an advantageous embodiment, the connection means are a type being easily releasable and connectable by a user for example a bayonet mount, a thread, a pinol screw, or a snap active connection.

In order for the user to be able to easily release and connect the cover element from the housing of the watch, the first connection means on the top ring and the second connection means on the second flange are released or connected easily. However, the connection means are still to be able to cooperate in a manner preventing the cover element from detaching undesirably, since the at least one moveable element hereby could be lost.

The connection means can, for example, be a thread, hereby screwing the cover element onto the housing of the watch. Alternatively, the connection means can be a bayonet mount, where a protrusion on the second flange or the top ring connects with a curved groove on the top ring or the second flange, respectively. Alternatively, the connection means is a pinol screw, which is inserted radially to the second flange and is screwed through the top ring and into the second flange connecting the two. Alternatively, the connection means is a snap connection, where the snap connection is released by pressing a snap.

In a further advantageous embodiment, the first connection means are arranged on an inner side of said top ring and that said second connection means are arranged on an outer side of said second flange.

Hereby, the top ring is arranged outside the second flange. The cover element is easily connected to the housing since the top ring is not to be arranged into the groove of the housing. For example, if the connection means is a thread, the cover element is screwed onto the housing easily having a grip along the top ring.

Furthermore, the groove and the at least one moveable element are not be affected by the connection of the cover element. If the cover element was to be connected onto the inside of the second flange, the top ring would take up some of the place within the groove and during the connection the at least one moveable element could easily interfere with the connection or be damaged.

In a further advantageous embodiment, the top ring is provided with knurls for obtaining a better grip. The connection between the cover element and the housing is made easier by knurling the surface of the top ring, since the surface of the top ring is less slippery. Hence, the fingers of the user get a better grip along the top ring, and the cover element is easily released and connected.

In a further advantageous embodiment, the cover element comprises a decoration. In a still further advantageous embodiment, the decoration is arranged on said top ring.

In order to further enhance the aesthetic appearance of the watch, the cover element can comprise a decoration. The decoration can be metal ornaments, precious stones, figures or patterns made in different types of materials, for example, different types of glass. The decoration can be arranged on the whole cover element or only parts hereof. Alternatively, the decoration is arranged on the top ring alone.

The first cover element can be replaced by a second cover element, and the watch will appear differently, even though the at least one movable element is of the same number and type. Hereby, multiple combinations are possible for one single watch by changing the number and type of the at least one movable element or by changing the cover element for example from a cover element with no decoration to a cover element comprising precious stones on the top ring.

In a further advantageous embodiment, the at least one movable element is a precious stone or a pearl. The precious stone can be, but is not limited to, a diamond, a black diamond, an amethyst, a blue sapphire, a yellow sapphire, a pink sapphire, a ruby, a topaz or tsavorite.

Alternatively, the at least one moveable element is a stone such as an onyx, a malachite, an azurite, a garnet, an opal, a topaz, or a zircon.

In a still further advantageous embodiment, the precious stone is mounted in a stone housing. Hereby, the stone is easier to handle and to arrange correctly into the groove of the housing. Furthermore, the movement of the stone is enhanced by mounting it into the stone housing. In addition, the stone housing prevents the stone from tilting in the groove and enables the stone to maintain a correct position.

The stone housing can be made of, for example, metal such as gold, silver, white gold, titanium or tantalum.

The stone housing can be formed to fit into the groove, the sides of the stone housing being parallel to the sides of the groove, i.e. if the bottom of the groove is concave, the bottom of the stone housing would be concave as well.

In a further advantageous embodiment, the height of said at least one moveable element is substantially the height of said groove.

Hereby, the at least one moveable element is arranged into the groove, the top of the at least one moveable element is substantially in the same plane as the top of the flanges.

If the at least one moveable element was higher than the height of the groove, a part of the at least one moveable element would be above the top of the flanges. This part of the at least one moveable element may interfere with the cover glass of the cover element when the cover element is connected to the housing. Hereby, the at least one moveable element may damage the cover glass, or the cover element may not be properly attached to the housing.

If the at least one moveable element is considerably lower than the height of the groove, the at least one movable element may be able to rotate inside the groove, whereby the at least one moveable element will no longer be properly arranged. This means that if the at least one moveable element is a precious stone in a stone housing, the bottom of the stone housing may be rotated to be visible through the cover glass, instead of the precious stone.

In a further advantageous embodiment, at least a part of said at least one movable element is substantially circular and has a diameter substantially of the size of the width of said groove.

Hereby, each moveable element is in contact with both the first and the second flange. The movement of the at least one movable element is along the groove between the first and the second flange. Hence, the direction of the movement of the at least one moveable element can be controlled.

In a further advantageous embodiment, the cover glass is curved. When the cover glass is curved, reflection can be provided and the time on the watch can easily be observed at all times.

DETAILED DESCRIPTION OF THE INVENTION

FIG. 1-FIG. 7 illustrates a watch 101 according to the invention and how to remove and replace moveable elements 103, 105 and cover elements 107, 109.

Figure 1:
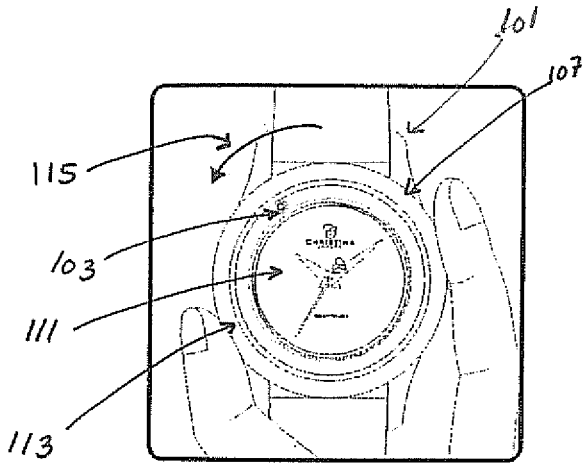
FIG. 1 illustrates a watch where a first cover element is to be released.
Figure 2:
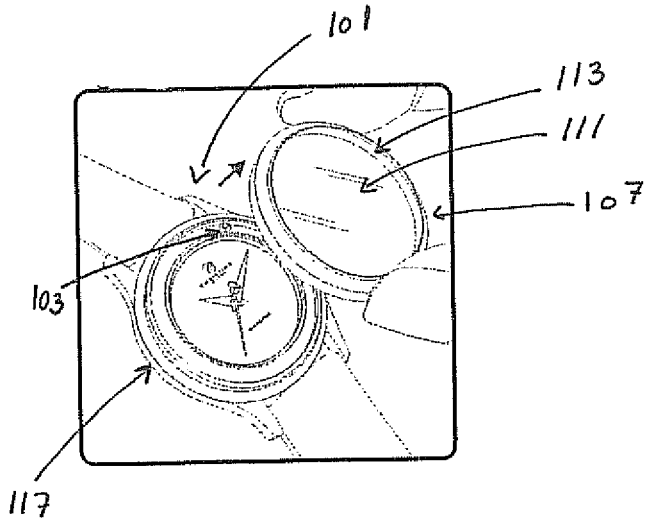
FIG. 2 illustrates a watch where a first cover element is released.

FIG. 1 illustrates a watch 101 comprising a first cover element 107 comprising a first cover glass 111 and a first top ring 113 and a first moveable element 103. The first cover element 107 is turned towards the left in direction of the release arrow 115. Hereby, the first cover element 107 can be released from the housing 117 of the watch 101. After releasing the first cover element 107 from the housing 117, the first cover element 107 is removed from the housing 117 as illustrated in FIG. 2.

Figure 3:
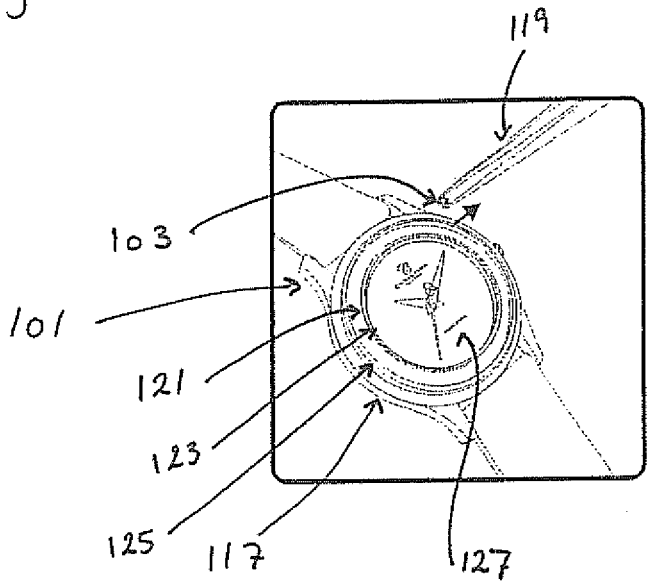
FIG. 3 illustrates a watch where a first moveable element is being removed.
Figure 4:
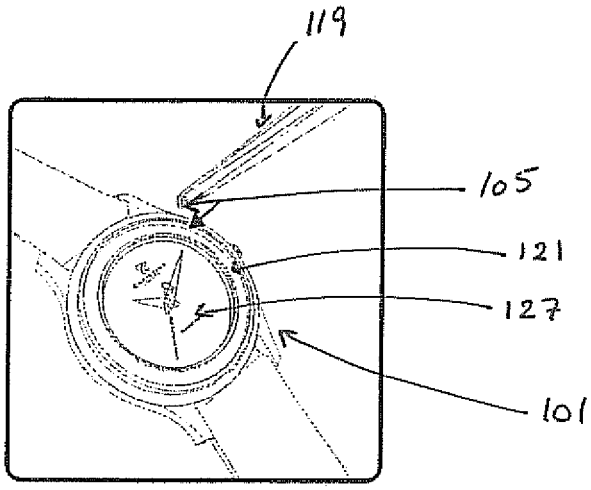
FIG. 4 illustrates a watch where a second moveable element is being inserted into a groove.

As illustrated in FIG. 3, a pair of tweezers 119 can be used for removing the first moveable element 103 from the groove 121 of the housing 117. The groove 121 is formed by a first flange 123 and a second flange 125. Hereafter, a second moveable element 105 can be arranged into the groove 121 of the housing 117 as illustrated in FIG. 4. The second moveable element 105 is advantageously arranged using a pair of tweezers 119.

A watch glass 127 is provided enclosed in the first flange 123 protecting the watch case comprising the mechanical and/or electrical components from the tweezers 119.

Figure 5:
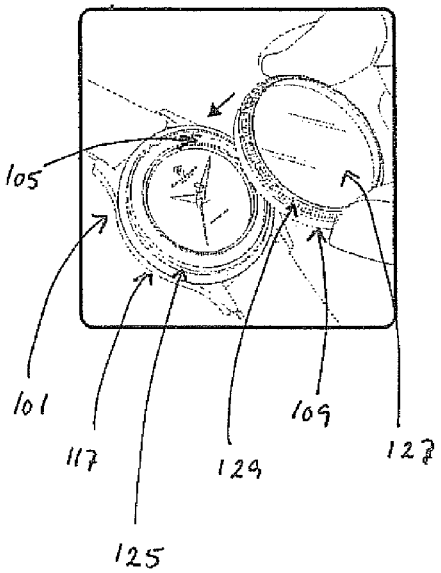
FIG. 5 illustrates a watch where a second cover element is arranged over the housing of the watch.
Figure 6:
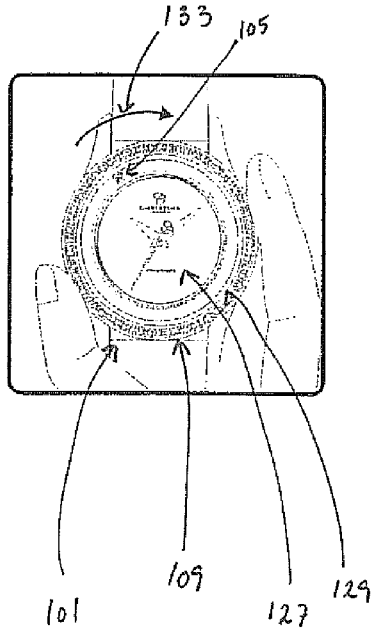
FIG. 6 illustrates a watch where a second cover element is connected to the housing of the watch.

Hereafter, a second cover element 109 comprising a second cover glass 127 and a second top ring 129 can be arranged on top of the housing 117 as illustrated in FIG. 5. The second cover element 109 comprises a decoration on the second top ring 129. The second cover element 109 is connected to the second flange 125 of the housing 117 by turning the second cover element 109 to the right with regard to the housing 117 according to the connection arrow 133 as illustrated in FIG. 6.

Figure 7:
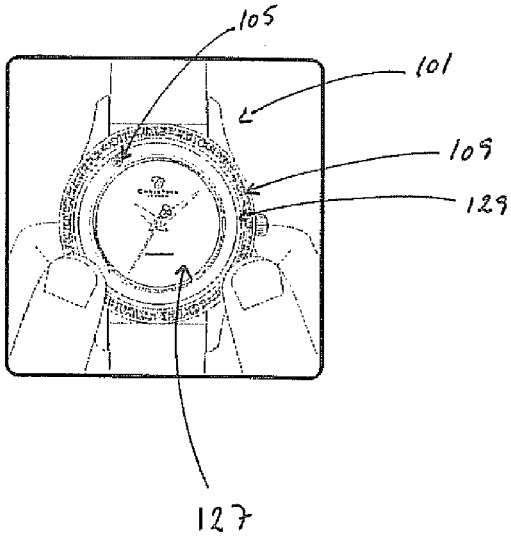
FIG. 7 illustrates a watch with a second moveable element and a second cover element.

The first cover element 107 is easily replaced by the second cover element 109 and the first moveable element 103 is easily replaced by the second moveable element 105. Thus, the appearance of the watch 101 can easily be changed by the user. FIG. 7 illustrates the watch as in FIG. 1 comprising the same housing 117, but with a second cover element 109 and a second moveable element 105.

Figure 8:
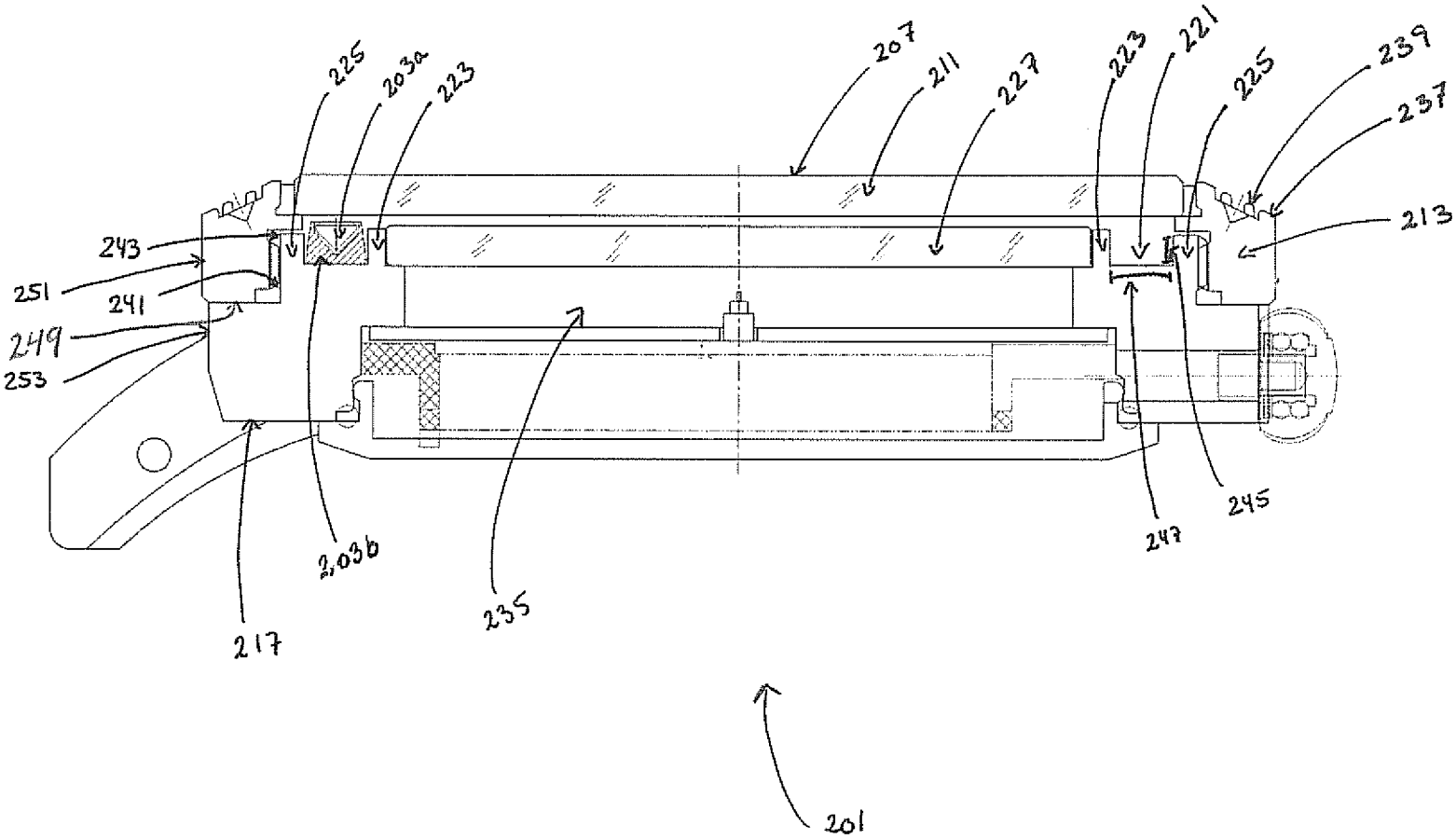
FIG. 8 illustrates a cross-sectional view of a watch comprising a housing, a moveable element and a cover element.

FIG. 8 illustrates a cross-section of a watch 201 comprising a housing 217 comprising a watch case 235, a first annular flange 223 and a second annular concentric flange 225 defining a groove 221 and a watch glass 227 enclosed by the first flange 223. The first annular flange 223 and the second annular flange 225 are arranged concentrically with the second annular flange 225 on the outside of the first annular flange 223.

A third moveable element 203 in the form of a precious stone 203*a* mounted in a stone housing 203*b* is arranged in the groove 221. The third moveable element 203 is substantially of the height 245 of the groove 221. The third moveable element 203 is circular with a diameter substantially the size of the width 247 of the groove 221.

Provided on top of the groove 221, the first annular flange 223 and the watch glass 227 is a cover glass 211 preventing the precious stone 203*a* from accidentally being displaced from the groove 221. The cover glass 211 is enclosed in a top ring 213. The cover glass 211 and the top ring 213 are comprised in a cover element 207.

In this embodiment, the top ring 213 comprises slanting top edges 237 provided with knurls 239. The knurls 239 improve the grip on the top ring 213 during releasing and connecting of the cover element 207 to the housing 217.

The cover element 207 is connected to the housing 217 through releasable cooperation between the first connections means 241 on the inner side of the top ring 213 and the second connections means 243 on the outer side of the second flange 225. Here the connections means are provided in the form of cooperating threads.

In this embodiment, the bottom 249 of the top ring 213 rests on the housing 217. Hereby, the outer side 251 of the top ring 213 is substantially aligned with the outer side 253 of the housing 217.

The invention claimed is:

1. A watch (201) comprising a housing (217) comprising a watch case (235) and a fixed attached watch glass (227), a first annular flange (223) and a second concentric annular flange (225) arranged outside the first flange (223), thereby defining a groove (221) containing at least one moveable element (103,105, 203), wherein said watch glass (227) is attached to the first flange (223), wherein said watch (201) further comprises a cover element (207) having a top ring (213) with first connection means (241) enclosing a cover glass (211), wherein said second flange (225) is provided with second connection means (243) releaseably cooperating with said first connection means (241) and wherein said cover glass (211) covers said watch glass (227) and said groove (221).

2. The watch (201) according to claim 1, wherein said connection means (241, 243) are a type being easily releasable and connectable by a user.

3. The watch (201) according to claim 2, wherein said connection means are a bayonet mount, a thread, a pinol screw, and a snap connection.

4. The watch (201) according to claim 1, wherein said first connection means (241) are arranged on an inner side of said top ring (213) and wherein said second connection means (243) are arranged on an outer side of said second flange (225).

5. The watch (201) according to claim 1, wherein said top ring (213) is provided with knurls (239) for obtaining a better grip.

6. The watch (201) according to claim 1, wherein said cover element (207) comprises a decoration.

7. The watch (201) according to claim 6, wherein said decoration is arranged on said top ring (213).

8. The watch (201) according to claim 1, wherein said at least one movable element (203) is a precious stone (203*a*) or a pearl.

9. The watch (201) according to claim 8, wherein said precious stone (203*a*) is mounted in a stone housing (203*b*).

10. The watch (201) according to claim 1, wherein the height of said at least one moveable element (103, 105, 203) is substantially the height (245) of said groove (221).

11. The watch (201) according to claim 1, wherein at least a part of said at least one movable element (103, 105, 203) is substantially circular and has a diameter substantially of the size of the width (247) of said groove (221).

12. The watch (201) according to claim 1, wherein said cover glass (211) is curved.

13. The watch (201) according to claim 1, wherein the first and second annular flanges (223, 225), the groove (221), the cover element (207), the cover glass (211) and the top ring (213) are arranged on top of the housing (217).

14. The watch (201) according to claim 1, wherein the first connection means (241) is on an inner side of the top ring (213).

15. The watch (201) according to claim 14, wherein a bottom (249) of the top ring (213) rests on the housing (217).

16. The watch (201) according to claim 14, wherein an outer side (251) of the top ring (213) that holds the cover glass (227) is substantially aligned with an outer side (253) of the housing (217).

* * * * *